US009131738B2

(12) United States Patent
Ly

(10) Patent No.: US 9,131,738 B2
(45) Date of Patent: Sep. 15, 2015

(54) MULTI-LAYERED CONSTRUCTIONS WITH SHAPED BAFFLES

(75) Inventor: John Thiet Ly, Richmond, CA (US)

(73) Assignee: THE NORTH FACE APPAREL CORP., Wilmington, DE (US)

( * ) Notice: Subject to any disclaimer, the term of this patent is extended or adjusted under 35 U.S.C. 154(b) by 454 days.

(21) Appl. No.: 13/181,788

(22) Filed: Jul. 13, 2011

(65) Prior Publication Data

US 2013/0014317 A1 Jan. 17, 2013

(51) Int. Cl.

| | |
|---|---|
| ***A41D 31/00*** | (2006.01) |
| *A47G 9/08* | (2006.01) |
| *A41D 3/00* | (2006.01) |

(52) U.S. Cl.

CPC ..... *A41D 31/0038* (2013.01); *A41D 3/00* (2013.01); *A41D 2400/10* (2013.01); *A47G 9/08* (2013.01)

(58) Field of Classification Search

USPC ..... 2/456

See application file for complete search history.

(56) References Cited

U.S. PATENT DOCUMENTS

| | | | | |
|---|---|---|---|---|
| 2,851,390 | A * | 9/1958 | Chavannes | 428/137 |
| 3,805,720 | A | 4/1974 | Hunt | |
| 3,988,791 | A | 11/1976 | Simon | |
| 4,048,675 | A | 9/1977 | Griffin | |
| 4,115,610 | A * | 9/1978 | Wortman | 428/102 |
| 2005/0217029 | A1 | 10/2005 | Funatogawa | |
| 2006/0046024 | A1 * | 3/2006 | Huntley | 428/137 |
| 2009/0155543 | A1 * | 6/2009 | Fowler | 428/179 |
| 2010/0086730 | A1 | 4/2010 | Lo et al. | |
| 2012/0036642 | A1 * | 2/2012 | Brogan et al. | 5/644 |

OTHER PUBLICATIONS

International Search Report of PCT/US2012/046505 issued Oct. 10, 2012.

Partial Supplementary European Search Report mailed Mar. 26, 2015 in EP Application No. 12811841.1-1705.

* cited by examiner

*Primary Examiner* — Katherine Moran

(74) *Attorney, Agent, or Firm* — Kenyon & Kenyon LLP

(57) ABSTRACT

A multi-layered construction includes a first fabric, a second fabric, and a baffle disposed between the first and second fabrics. The baffle is attached to the first and second fabrics so as to form a plurality of triangular-shaped chambers between the first and second fabrics. In other words, the baffle forms a zigzag-like pattern between the first and second fabrics. Another multi-layered construction also includes a first fabric, a second fabric, and a baffle disposed between the first and second fabrics. This baffle has a non-rectangular cross-section. More particularly, in certain examples, the baffle may have at least one curved edge and/or at least one tapered edge. In other examples, the baffle may have a vase-like cross-section having at least two curved edges.

13 Claims, 5 Drawing Sheets

MULTI-LAYERED CONSTRUCTIONS WITH SHAPED BAFFLES

TECHNICAL FIELD

The present invention generally relates to multi-layered constructions, having shaped baffles, for use in products such as garments and sleeping bags.

BACKGROUND

Products such as jackets and other garments are often formed from multi-layered constructions made up of a plurality of fabrics. Often, pieces of material commonly referred to as baffles separate the various layers of the construction from one another. For example, these baffles may be provided between the two outer-most layers of a construction to create air chambers, into which material such as down may be added. These baffles have simple shapes with a rectangular profile in order to facilitate ease of manufacturing and placement.

Conventional baffles have several shortcomings, however. In general, they do nothing to add to the overall strength of the construction, acting instead of as mere spacers for various layers of material. Additionally, typical baffles have a single thickness throughout. This substantially limits the functional aspects of the product into which the baffle is inserted. For example, a designer of a jacket cannot easily pack more down material into the middle chest area of the jacket, while providing less down material at the edges, without the resulting product being misshapen.

Accordingly, there is a need for improved multi-layered constructions that include baffles capable of providing additional strength and design flexibility to the construction.

SUMMARY

The present invention generally relates to shaped baffles for use in consumer products such as garments and sleeping bags. In general, the shaped baffles have non-rectangular cross-sections and are employed as part of a multi-layered construction.

One example of a multi-layered construction in accordance with certain embodiments of the present invention includes a first fabric, a second fabric, and a baffle disposed between the first and second fabrics. The baffle is attached to the first and second fabrics so as to form a plurality of triangular-shaped chambers between the first and second fabrics. In other words, the baffle forms a zigzag-like pattern between the first and second fabrics.

Another example of a multi-layered construction in accordance with certain other embodiments of the present invention includes a first fabric, a second fabric, and a baffle disposed between the first and second fabrics. The baffle has a non-rectangular cross-section. More particularly, in certain embodiments, the baffle may have at least one curved edge. In other embodiments, the baffle may have at least one tapered edge. In still other embodiments, the baffle may have a vase-like cross-section having at least two curved edges. In additional embodiments, the baffle may have at least one curved edge and at least one tapered edge.

The present invention also provides jackets and garments that include the multi-layered constructions described herein.

The following detailed description, taken in conjunction with the drawings, discloses examples of the invention. Other embodiments, which incorporate some, all or more of the features as taught herein, are also possible.

BRIEF DESCRIPTION OF THE DRAWINGS

The present invention will become more fully understood from the following detailed description and its accompanying drawings. These drawings are given by way of illustration only and are not limitative of the present invention. The drawings provided with this application are as follows.

DETAILED DESCRIPTION

Figure 1:
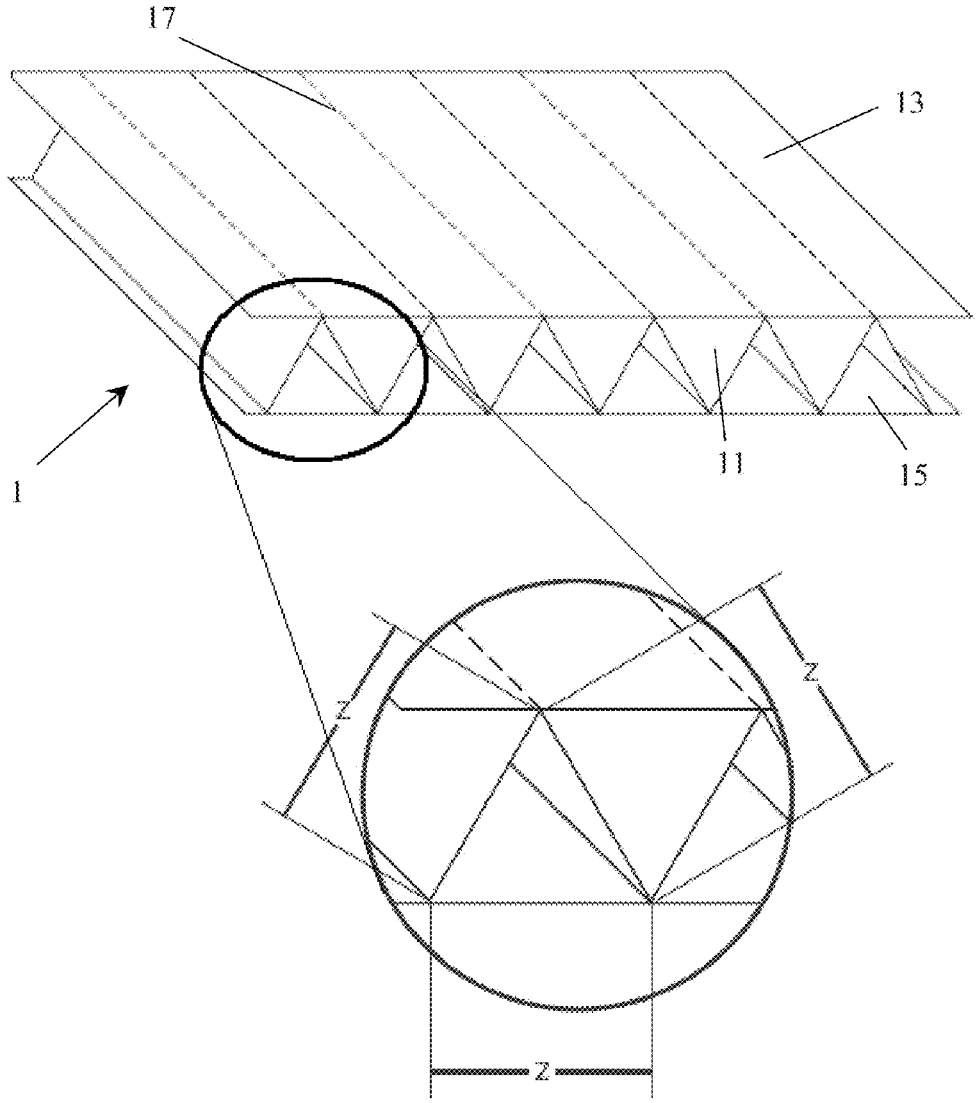
FIG. 1 shows a cross-sectional side-view of a multi-layered construction in accordance with certain embodiments of the present invention, as well as an enhanced view of a portion of the construction.

The present invention generally relates to shaped baffles provided within multi-layered constructions. These constructions form both insulating and non-insulating products such as garments, sleeping bags, blankets, and the like. While a preferred example of a jacket is described as an exemplary product, a construction in accordance with the present invention may be used in a broad range of products, such as blankets, tents, sleeping bags, and other outdoor gear, as well as gloves, shirts, pants, undergarments, hats, boots, and other apparel. Further, the shaped baffles described herein may be employed in items such as pillows, sheets, comforters, blankets, and the like. Additionally, the shaped baffles described herein may be used as part of an insulating construction for any warm object that gives off heat. As such, a construction of the present invention may also be employed by the food service industry or similar fields for use in constructing apparatuses that keep hot items at a proper temperature during transport or storage.

In general, the baffles in accordance with the present invention have a non-rectangular cross-section or profile. While this may complicate the fabrication process for the baffle, as well as the assembly of the products themselves, the added strength and design flexibility greatly improves upon conventional down constructions.

The complex shapes of the baffles described in accordance with the present invention provide additional strength and flexibility to various products. Unlike traditional baffles, which employ a rectangular cross-section or profile, the baffles in accordance with the present invention add stability to the construction, much like the shape of a truss or arch adds stability to a bridge.

Additionally, the complex shapes of these baffles provide an added degree of flexibility in designing the products of which they are a part. For example, a garment designer could specially-tailor a baffle to vary in thickness, in accordance with complicated design specifications, to form a variance of voids or pockets in specific areas. This would allow the designer to place more insulating material into one area of the construction than in another without the need for using separate baffles or constructions. In addition, this can eliminate the need for excess material, which reduces the overall weight/bulkiness of the construction, as well as prevents bunching up of excess fabric.

The following exemplary baffles in accordance with the present invention are described as being provided between "first" and "second" fabrics. Note, however, that the baffles need not be arranged between the two outer-most layers of the construction (for example, exterior- and interior-facing fabrics of a garment). Indeed, the baffles described in accordance with the present application may be employed between any two layers of a construction; and one or more layers may be included outside of the first and second layers described here. Similarly, one or more additional layers may be included between the first and second layers; and the baffles may extend through or around them as needed.

A first embodiment of the present invention is shown in FIG. 1. Here, a multi-layered construction 1 includes a baffle 11 having a triangular shape. Baffle 11 is provided between a first fabric 13 and a second fabric 15 so as to form a triangular, zigzag pattern. In other words, baffle 11 may be attached to first fabric 13 and second fabric 15 so as to form a plurality of triangular-shaped voids/chambers. First fabric 13 and second fabric 15 may be, in certain embodiments, an exterior-facing fabric and an interior-facing fabric of a garment, respectively.

In preferred embodiments, the cross-sections of these triangular-shaped chambers are equilateral triangles, having sides of length Z, as best shown in the enhanced view of FIG. 1. However, other cross-sectional configurations are also possible, such as isosceles triangles or triangles having sides of three different lengths.

The sizes of the triangular-shaped chambers may vary based on the particular application of the construction. For example, if more insulation is required, the baffle may be configured so as to provide larger chambers. In one particular example, baffle 11 forms triangular-shaped chambers each having sides of one inch in length (that is, Z=1 inch). In other examples, the size of the chambers within a single construction may vary as needed for a particular application.

Material such as down may be placed in the chambers. Alternatively, the chambers may simply contain air.

Portions of the fabric comprising baffle 11 may be joined to first fabric 13 and second fabric 15 at one or more seams 17. In preferred embodiments, baffle 11 is stitched to fabrics 13 and 15 at a plurality of seams 17. Other methods of joining the materials are possible, however, including bonding, gluing with an adhesive, sonic welding, or any suitable substitute for stitching known in the art.

Preferably, baffle 11 is made from a single piece of material. In other embodiments, however, baffle 11 could be formed of several pieces of material joined together at seams 17 or other points by any suitable method known in the art.

This construction is particularly well-suited for jackets and similar products. However, the construction shown in FIG. 1 may also be applied to other types of garments or other products such as sleeping bags and blankets.

The zigzag baffle of this embodiment of the present invention greatly increases the overall structural stability of the construction of which it is a part. Specifically, when the baffle is configured to form chambers or voids having the profile of equilateral triangles, the construction is able to support itself without the need to insert down or other material into the chambers. Constructions employing typical baffles lack this ability.

In general, additional embodiments of the present invention include baffles formed with at least one curved or tapered edge. In other words, these baffles in general have a non-rectangular cross-section. Specific examples will be described with reference to FIGS. 2-4.

Figure 2:
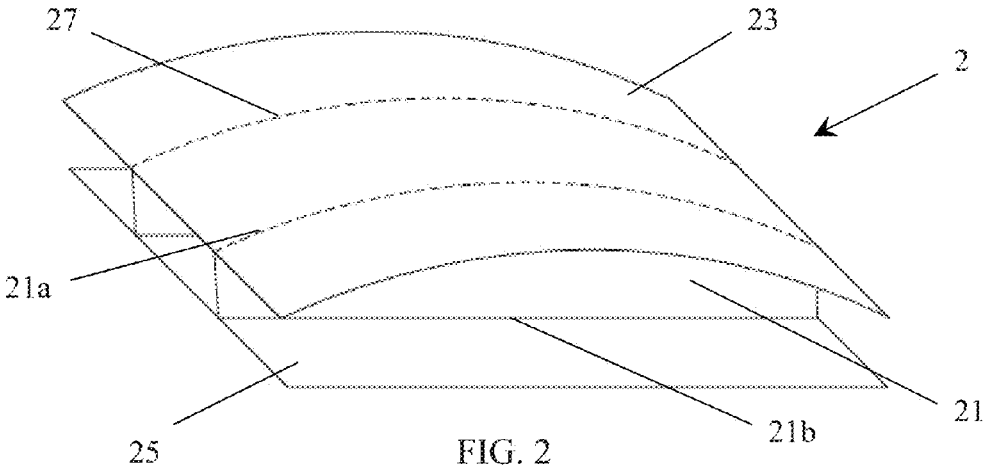
FIG. 2 shows a cross-sectional side view of another multi-layered construction in accordance with certain embodiments of the present invention.

A second embodiment of the present invention is shown in FIG. 2. Here, a construction 2 includes a baffle 21 attached between a first fabric 23 and a second fabric 25 at seams 27. Baffle 21 attaches to fabrics 23 and 25 using any suitable method known in the art, including stitching, sewing, bonding, sonic welding, and the like. First fabric 23 and second fabric 25 may be, in certain embodiments, an exterior-facing fabric and an interior-facing fabric of a garment, respectively.

As best seen in FIG. 2, baffle 21 has a curved edge/surface abutting first fabric 23. Overall, baffle 21 has a first edge 21*a* (abutting and attached to fabric 23) with a curved/elliptical shape and a second edge 21*b* (abutting and attached to fabric 25) that is substantially flat. In other embodiments, the baffle may have two curved edges, such that each end of the baffle is a mirror image of the other.

Curved edge 21*a* may be formed by pleating, darting, bellowing, folding, or similar methods. Alternatively, this edge may be formed by laser cutting or other methods of removing fabric.

Figure 3A:
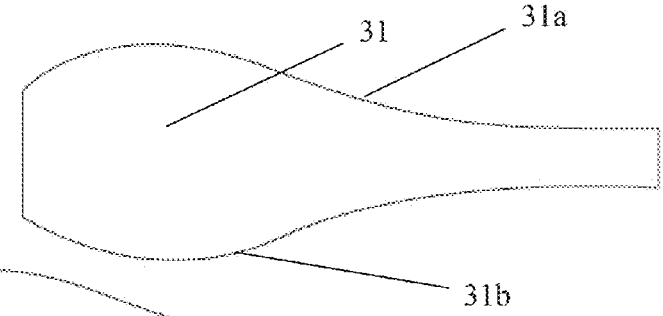
FIG. 3A shows a shaped baffle that forms a part of still another multi-layered construction in accordance with still another embodiment of the present invention.
Figure 3B:
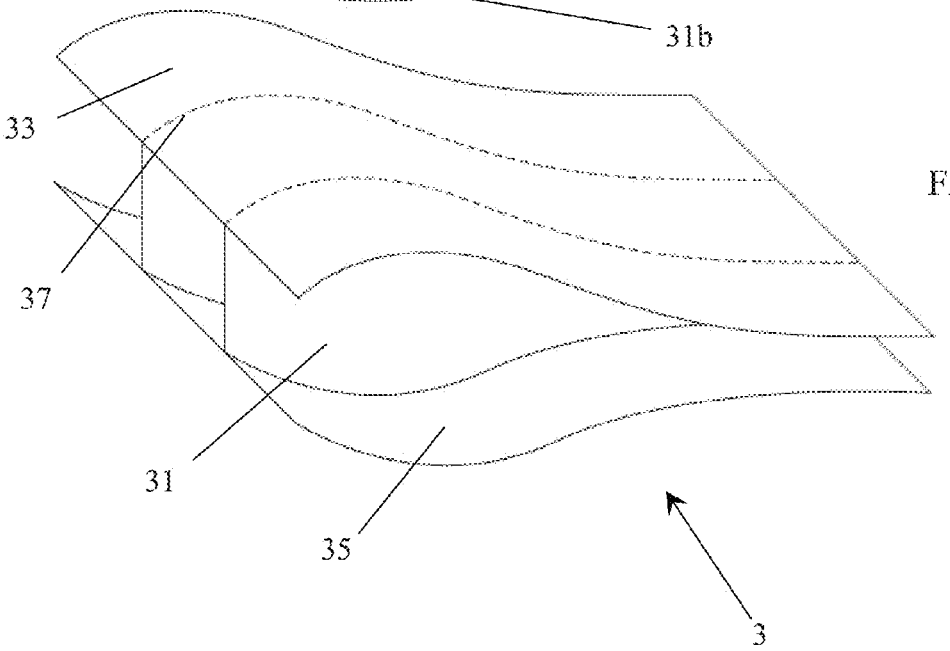
FIG. 3B shows a multi-layered construction employing the shaped baffle of FIG. 3A.

A third embodiment of the present invention is shown in FIGS. 3A and 3B. In this embodiment, a baffle may include at least one curved edge/surface. As shown in FIG. 3B, a construction 3 includes a baffle 31 attached between a first fabric 33 and a second fabric 35 at seams 37. First fabric 33 and second fabric 35 may be, in certain embodiments, an exterior-facing fabric and an interior-facing fabric of a garment, respectively.

As best seen in FIG. 3A, baffle 31 has a first curved edge 31*a* that forms a somewhat-sinusoidal shape. Baffle 31 may also include a second curved edge 31*b* that generally mirrors that of edge 31*a*. Baffle 31 may attach to first fabric 33 and second fabric 35 at edges 31*a* and 31*b*, respectively, by any suitable method known in the art, such as stitching, sewing, sonic welding, adhesive bonding, and the like.

In general, the curved edges 31*a* and 31*b* give baffle 31*a* substantially vase-like cross-section. That is, baffle 31 has a wider portion (toward the left-hand side of baffle 31) and a narrower portion (toward the right-hand side).

Tapered edges 31*a* and 31 may be formed by pleating, darting, bellowing, folding, or similar methods. Alternatively, these edges may be formed by laser cutting or other methods of removing fabric.

Figure 4A:
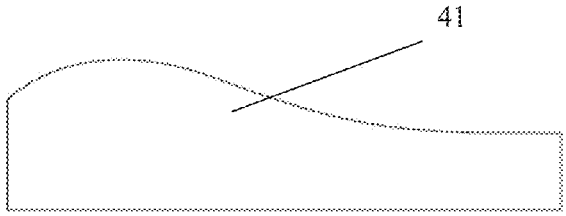
FIG. 4A shows a cross-sectional side view of a baffle (prior to shaping) that forms a part of yet another multi-layered construction in accordance with certain embodiments of the present invention.
Figure 4B:
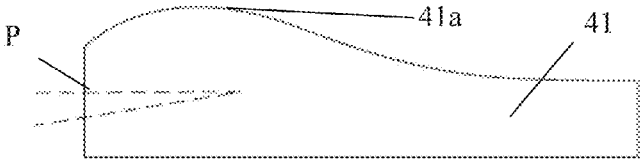
FIG. 4B shows the baffle of FIG. 4A with lines indicating pleating or folding.
Figure 4C:
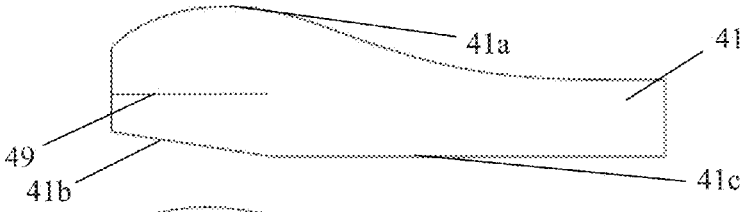
FIG. 4C shows the baffle of FIG. 4A after pleating or folding.
Figure 4D:
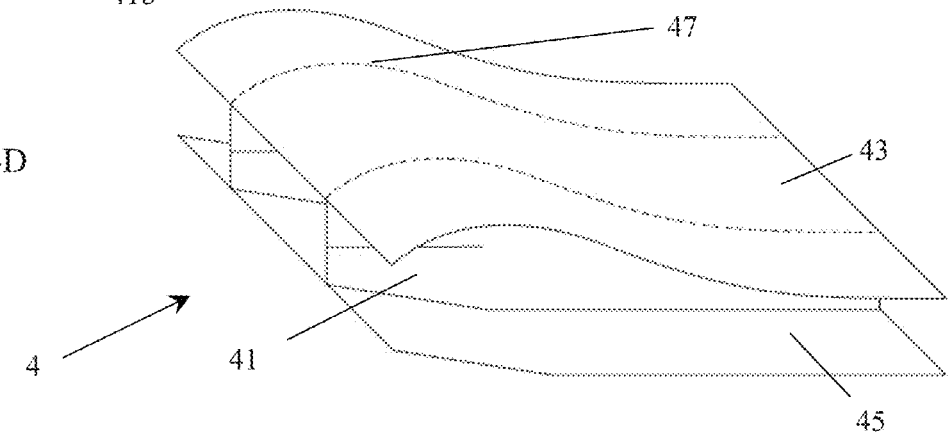
FIG. 4D shows a multi-layered construction employing the shaped baffle of FIG. 4C.

A fourth embodiment of the present invention is shown in FIGS. 4A-4D. In this embodiment, a baffle may include at least one curved edge/surface and at least one tapered edge/surface. In one particular example, a construction 4 includes a baffle 41 attached between a first fabric 43 and a second fabric 45 at seams 47, as best shown in FIG. 4D. First fabric 43 and second fabric 45 may be, in certain embodiments, an exterior-facing fabric and an interior-facing fabric of a garment, respectively.

As best seen in FIG. 4C, baffle 41 may have at least one curved edge 41*a* (similar in features to edges 31*a* and 31*b* of baffle 31) and at least one tapered edge 41*b*. Further, baffle 41 may include a substantially flat edge 41*c* adjacent to tapered edge 41*b* and opposed to curved edge 41*a*. Baffle 41 may attach to first fabric 43 and second fabric 45 at edges 41*a*-41*c* by any suitable method known in the art, such as stitching, sewing sonic welding, adhesive bonding, and the like.

Tapered edge 41*b* may be formed by pleating, darting, bellowing, folding, or similar methods. Alternatively, this edge may be formed by laser cutting or other methods of removing fabric. Additionally, curved edge 41*a* is preferably formed using laser cutting or similar methods for removing fabric. As shown in FIGS. 4A-4C, tapered edge 41*b* may be formed by folding or pleating a portion of a piece of material of rectangular cross-section along lines P to form a pleat 49.

The previously-described baffles may be constructed from a broad range of materials. Non-limiting examples include three-layers, wovens, knits, and natural or synthetic down. Preferably, the material is fiber-proof.

As shown in the preceding figures, two or more baffles may be employed in a single construction. The size, shape, and positions of these baffles may be selected to improve the strength and insulation of products such as garments, blankets, and sleeping bags. Additionally, one or more different types of the various baffles described herein may be used in a single product. That is, two or more of the constructions described previously can be combined in a single product. In other words, baffle 11 may be combined with baffle 31 in a single jacket or other garment, for example. This allows for improved flexibility in designing products for optimum strength and insulation.

Figure 5:
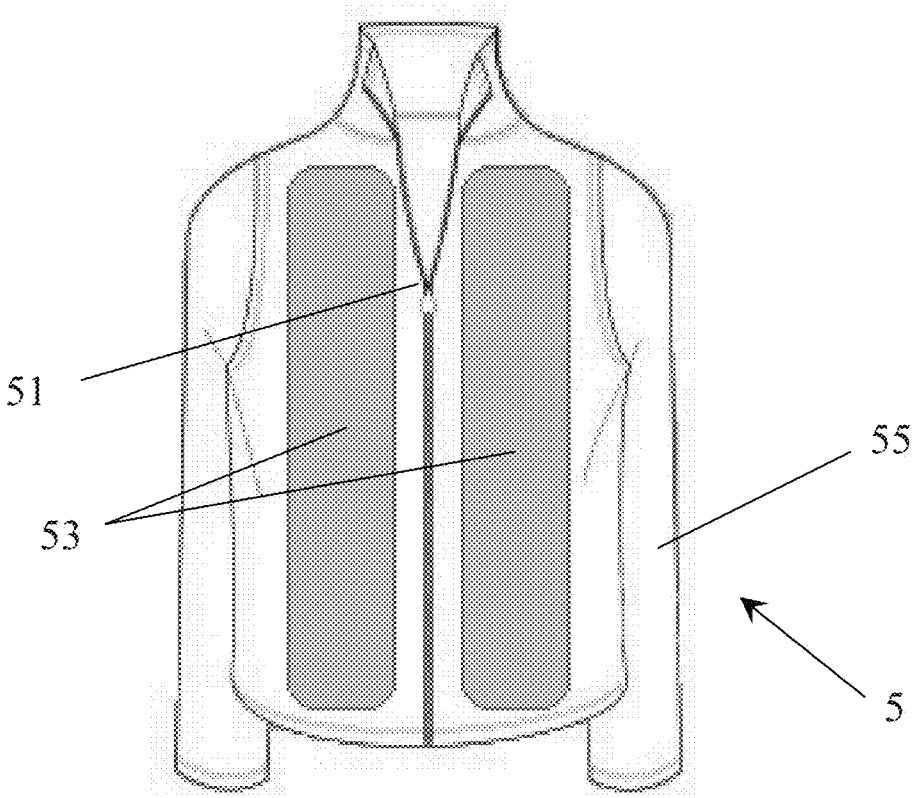
FIG. 5 shows a jacket including a multi-layered construction with a shaped baffle in accordance with certain embodiments of the present invention.

A multi-layered construction having the shaped baffles described previously may be used in various forms of garments, apparel, or other clothing, such as a jacket. The placement of these constructions may be location-specific based on body-mapped heat retention needs. As shown in FIG. 5, for example, a chest portion 51 of a jacket 5 may include a construction 53 to improve warmth, while sleeves 55 and a back portion (not shown) may be made of a single layer to improve heat dissipation (such as during high aerobic activities). Other items—such as hats, gloves, pants, and shirts—may also be designed based on this principle.

The first and second fabrics of the present invention may be made from any suitable material, including those made of natural and synthetic fibers. Examples of suitable materials include, but are not limited to, the following: nylon, polyester, DryLoft® (available from W.I. Gore), polytetrafluoroethylene (PTFE), breathable materials such as HyVent® (available from The North Face Inc.), canvas, cotton, wool, fleece, silk, flannel, rubber, microfiber, flax, bamboo, and gossamer. These fabrics may also be constructed of recycled materials.

While various embodiments have been described, other embodiments are plausible. The foregoing descriptions of various examples of a shaped baffle are not limiting. And any number of modifications, combinations, and alternatives of these examples may be employed to facilitate the effectiveness of providing improved strength and insulation in a garment, sleeping bag, or similar products.

Numerous other embodiments may be implemented without departing from the spirit and scope of these exemplary embodiments of the present invention. Moreover, while certain features of the invention may be shown on only certain embodiments, these features may be exchanged, added, and removed from and between the various embodiments.

I claim:

1. A multi-layered construction, comprising:

a first fabric;

a second fabric; and a plurality of baffles disposed between the first and second fabrics, the plurality of baffles having at least a first baffle and a second baffle, wherein the plurality of baffles are attached to the first and second fabrics so as to form a plurality of chambers between the first and second fabrics, and wherein a cross-section of the first baffle varies along the first baffle thereby varying distance between the first and the second fabrics, wherein a cross-section of the second baffle varies along the second baffle thereby varying distance between the first and the second fabrics, and wherein the cross-sections of the first and second baffles are different.

2. The multi-layered construction of claim 1, further comprising down material placed within at least one chamber of the plurality of chambers.

3. A garment comprising the multi-layered construction of claim 1.

4. The garment of claim 3, wherein the garment is a jacket.

5. A multi-layered construction, comprising:

a first fabric;

a second fabric; and a plurality of baffles disposed between the first and second fabrics, the plurality of baffles having at least a first baffle having a non-rectangular cross-section and a second baffle having a non-rectangular cross-section, wherein the plurality of baffles are attached to the first and second fabrics so as to form a plurality of chambers between the first and second fabrics, and wherein the cross-section of the first baffle varies along the first baffle thereby varying distance between the first and the second fabrics, wherein the cross-section of the second baffles varies along the second baffle thereby varying distance between the first and second fabrics, and wherein the cross-sections of the first and second baffles are different.

6. The multi-layered construction of claim 5, wherein at least one of the plurality of baffles has at least one curved edge.

7. A garment comprising the multi-layered construction of claim 6.

8. The garment of claim 7, wherein the garment is a jacket.

9. The multi-layered construction of claim 5, wherein at least one of the plurality of baffles has at least one curved edge and at least one tapered edge.

10. A garment comprising the multi-layered construction of claim 9.

11. The garment of claim 10, wherein the garment is a jacket.

12. A garment comprising the multi-layered construction of claim 5.

13. The garment of claim 12, wherein the garment is a jacket.

* * * * *